US011639570B2

(12) United States Patent
Azuma et al.

(10) Patent No.: US 11,639,570 B2
(45) Date of Patent: May 2, 2023

(54) SEWING MACHINE WITH THREADING DEVICE

(71) Applicant: JANOME SEWING MACHINE Co., Ltd., Hachioji (JP)

(72) Inventors: Toyohiro Azuma, Hachioji (JP); Takuya Sawada, Hachioji (JP); Koji Maeda, Hachioji (JP)

(73) Assignee: JANOME CORPORATION, Hachioji (JP)

( * ) Notice: Subject to any disclaimer, the term of this patent is extended or adjusted under 35 U.S.C. 154(b) by 361 days.

(21) Appl. No.: 17/055,374

(22) PCT Filed: Jun. 13, 2019

(86) PCT No.: PCT/JP2019/023440
§ 371 (c)(1),
(2) Date: Nov. 13, 2020

(87) PCT Pub. No.: WO2020/026603
PCT Pub. Date: Feb. 6, 2020

(65) Prior Publication Data

US 2021/0148027 A1 May 20, 2021

(30) Foreign Application Priority Data

Jul. 31, 2018 (JP) ..... JP2018-144593

(51) Int. Cl.
*D05B 87/02* (2006.01)

(52) U.S. Cl.
CPC ..... *D05B 87/02* (2013.01)

(58) Field of Classification Search
CPC ..... D05B 89/00; D05B 89/02; D05B 89/04
See application file for complete search history.

(56) References Cited

U.S. PATENT DOCUMENTS 5,596,940 A * 1/1997 Yamada ..... D05B 87/02 112/225
6,067,919 A * 5/2000 Shoji ..... D05B 87/02 112/225

(Continued)

FOREIGN PATENT DOCUMENTS

JP H08-173676 A 7/1996
JP H10-137482 A 5/1998

(Continued)

OTHER PUBLICATIONS

International Search Report (ISR) (PCT Form PCT/ISA/210), in PCT/JP2019/023440, dated Sep. 17, 2019.

(Continued)

*Primary Examiner* — Nathan E Durham
(74) *Attorney, Agent, or Firm* — McGinn I.P. Law Group, PLLC.

(57) ABSTRACT

[Purpose] To obtain a sewing machine comprising a device with which it is possible to easily perform a threading operation in which a needle thread is inserted into the needle hole of the sewing machine needle, wherein the sewing machine comprises a threading device configured so that the needle thread does not drop onto or coil around an operation part (operation part) of the operation lever of the threading device when a thread-hooking operation is completed before insertion of the needle thread. [Configuration] The present invention comprises: a needle bar 52; a threading shaft 53; a thread-holding tool 71; a threading tool 72 provided at the bottom end of the threading shaft 53; an operation lever 4 that has an operation part 41 and moves the threading shaft 53 up and down and rotates the threading shaft in the circumferential direction; and a cutting tool 93 for the needle thread n. The present invention is configured such that a needle thread guide member A, in which an inclined part 1 is formed that guides the needle thread n from the thread- (Continued)

holding tool 71 to the cutting tool 93, is provided between the thread-holding tool 71 and the cutting tool 93, and the inclined part of the needle thread guide member A guides the needle thread n that has been cut by the cutting tool out of the operation range of the operation lever 4.

7 Claims, 9 Drawing Sheets

(56) References Cited

U.S. PATENT DOCUMENTS

| | | | | |
|---|---|---|---|---|
| 6,564,731 | B2 * | 5/2003 | Sano | D05B 87/02 112/225 |
| 2010/0071603 | A1 * | 3/2010 | Miyoshi | D05B 87/02 112/225 |
| 2017/0088992 | A1 * | 3/2017 | Ueda | D05B 65/06 |

FOREIGN PATENT DOCUMENTS

| | | | |
|---|---|---|---|
| JP | 2000-271372 | A | 10/2000 |
| JP | 2005-160592 | A | 6/2005 |
| JP | 2006-158412 | A | 6/2006 |
| JP | 2010-017320 | A | 1/2010 |

OTHER PUBLICATIONS

Taiwanese Office Action, dated Jun. 19, 2020, in Taiwanese Application No. 10920581490 with partial English translation.

* cited by examiner

Fig. 1A
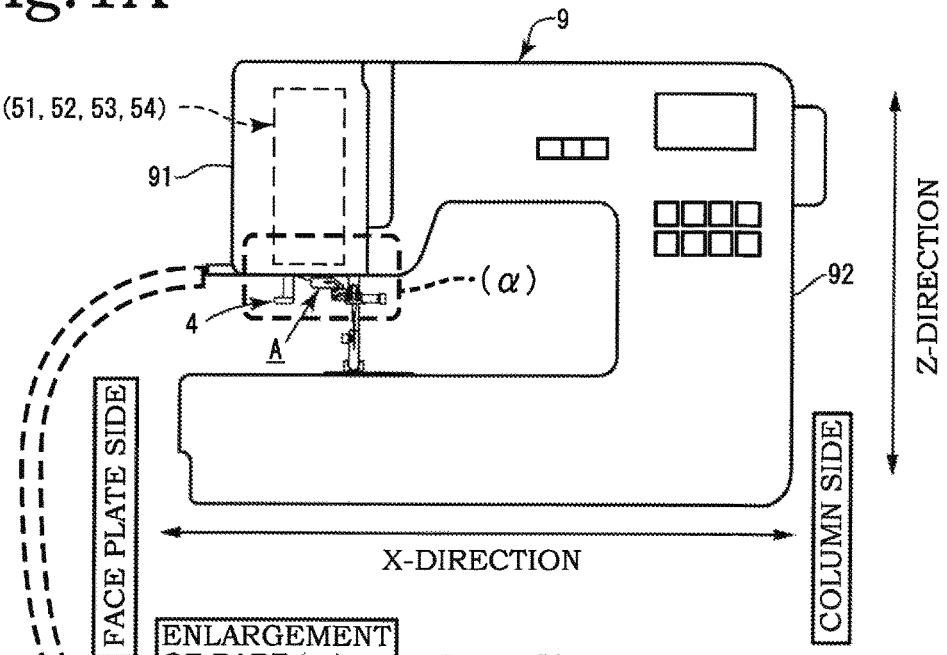
Fig. 1B
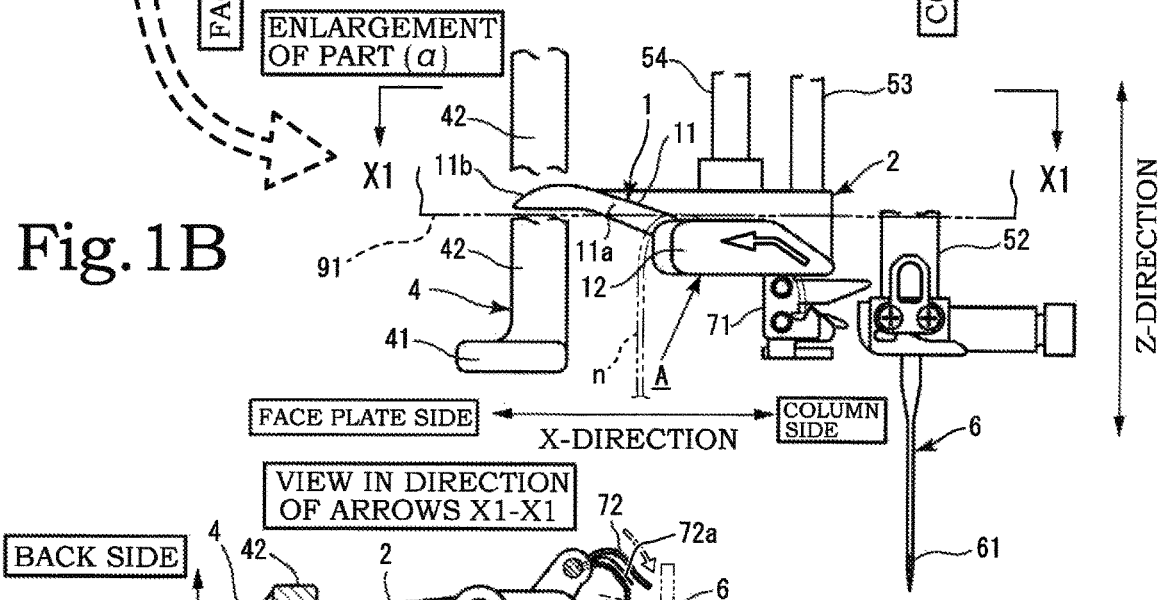
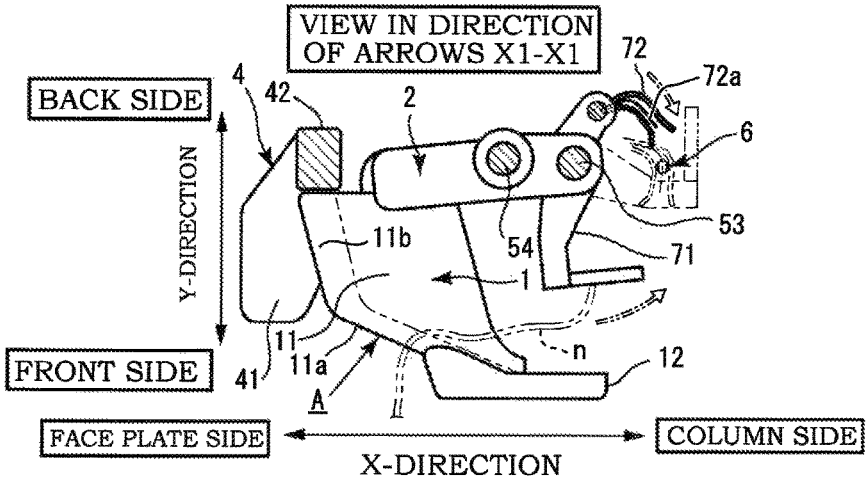
Fig. 1C

Fig.2A
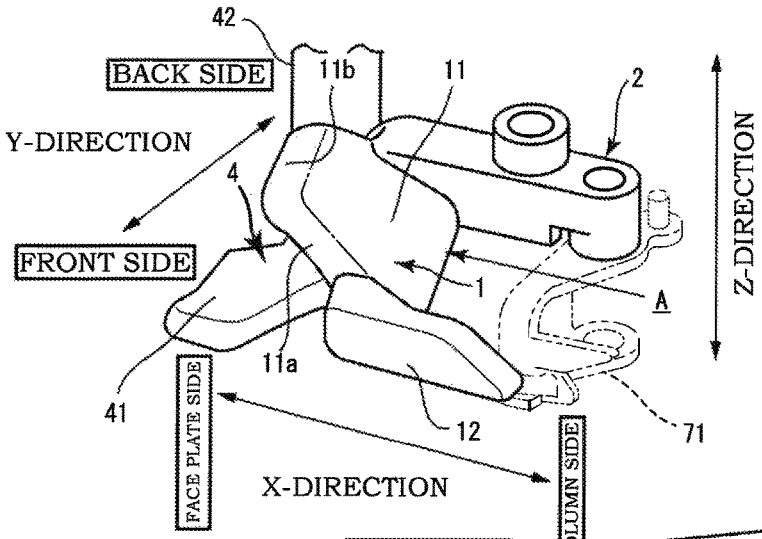
Fig.2B
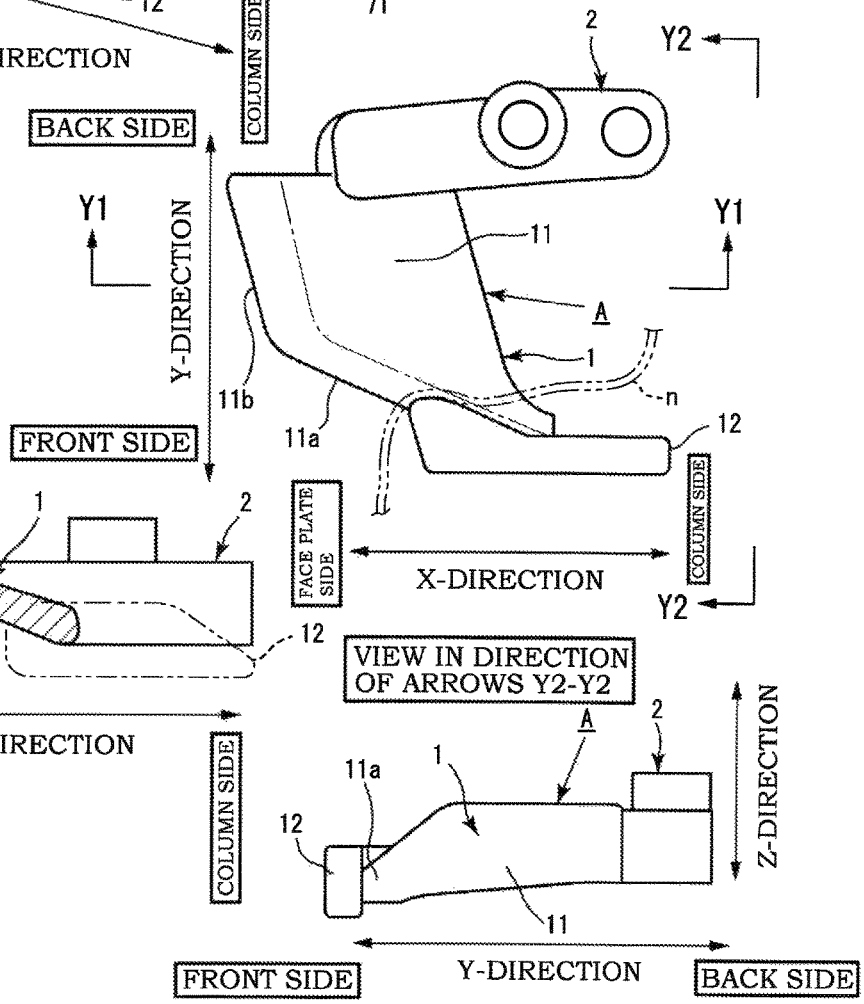
Fig.2C
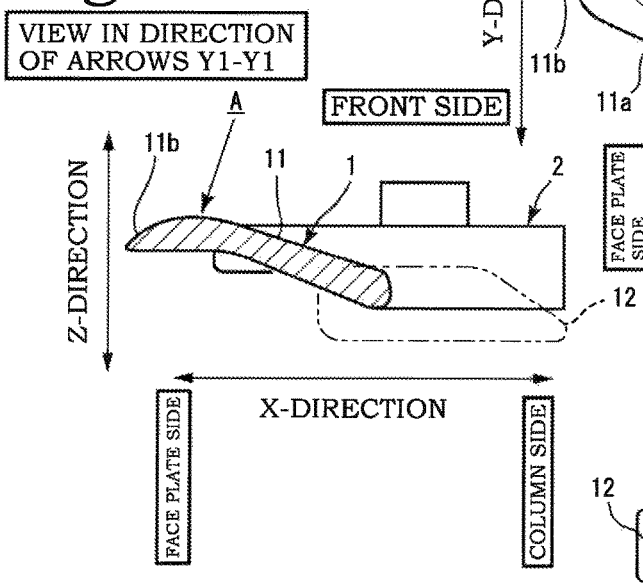
Fig.2D

Fig.4A
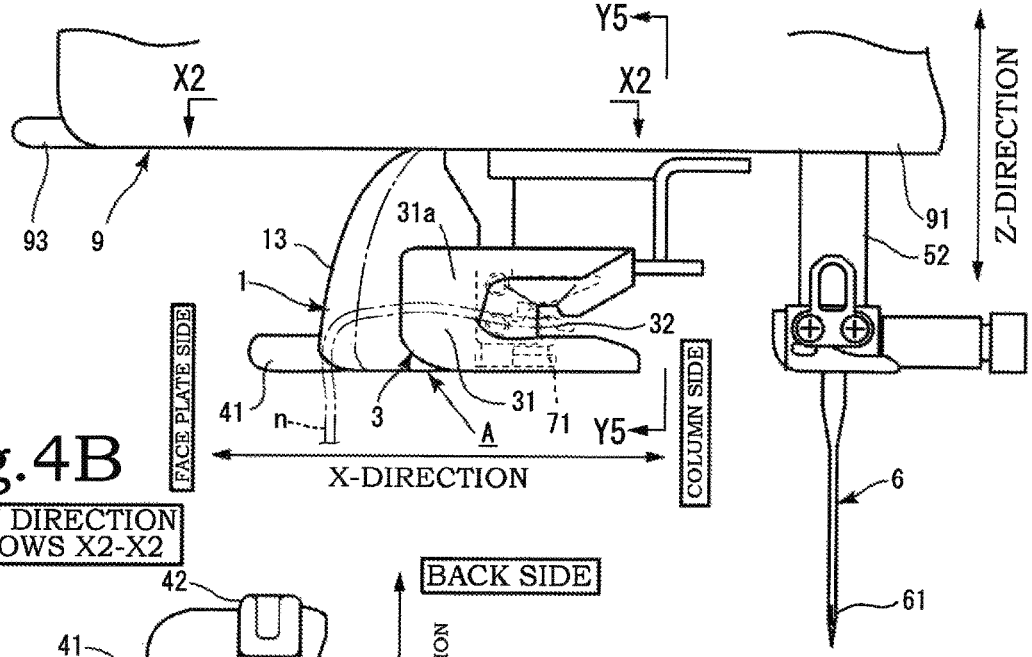
Fig.4B
VIEW IN DIRECTION OF ARROWS X2-X2
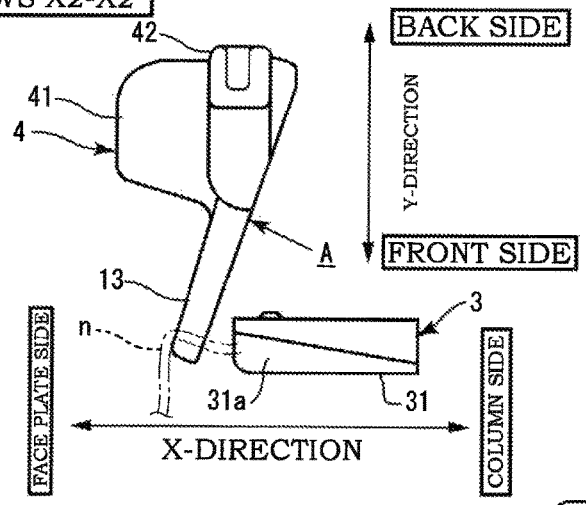
Fig.4C
VIEW IN DIRECTION OF ARROWS Y5-Y5
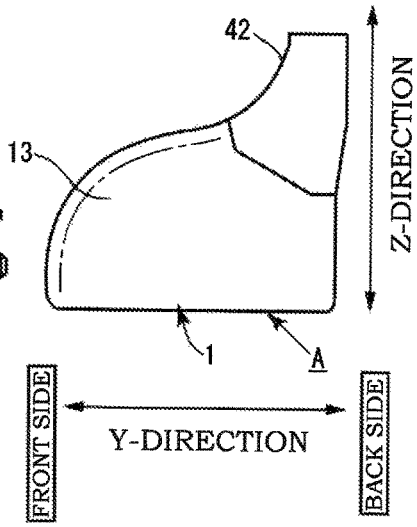
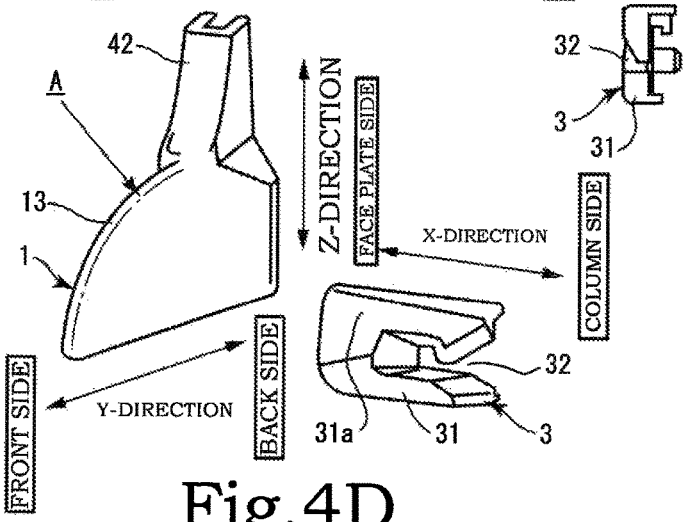
Fig.4D Z-DIRECTION
X3
X3
Y6
Y6
31a
3
32
31
A
FACE PLATE SIDE
COLUMN SIDE
X-DIRECTION VIEW IN DIRECTION OF ARROWS X3-X3
BACK SIDE
FRONT SIDE
Y-DIRECTION
3
31a
31
A
FACE PLATE SIDE
COLUMN SIDE
X-DIRECTION VIEW IN DIRECTION OF ARROWS Y6-Y6
31a
31
3
A
Z-DIRECTION
BACK SIDE
FRONT SIDE
Y-DIRECTION VIEW IN DIRECTION OF ARROWS X4-X4
VIEW IN DIRECTION OF ARROWS X5-X5
BACK SIDE
FRONT SIDE
Y-DIRECTION
X-DIRECTION
Z-DIRECTION
FACE PLATE SIDE
COLUMN SIDE
X4
X5
A
1
3
4
9
13
31
31a
32
41
42
93
n Fig.7A
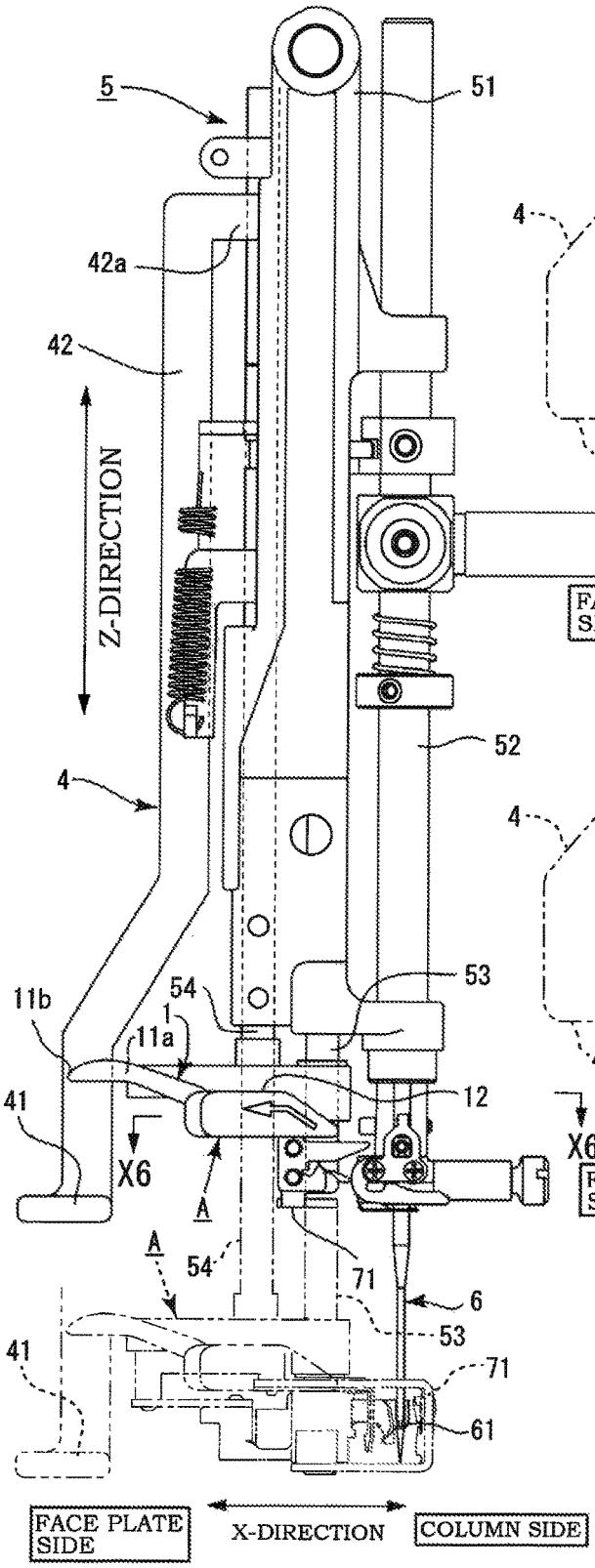
Fig.7B
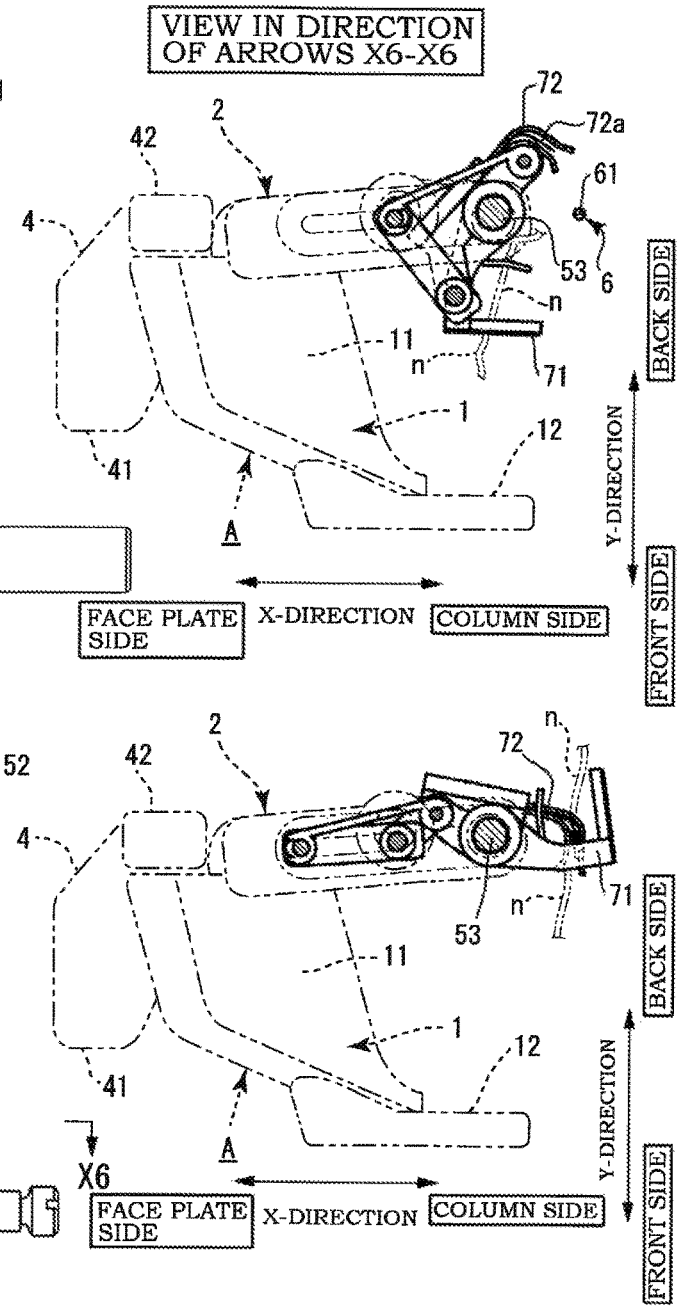
Fig.7C

SEWING MACHINE WITH THREADING DEVICE

TECHNICAL FIELD

The present invention relates to a sewing machine equipped with a device that allows for easy needle threading operation for passing a top thread through the needle hole of the sewing machine needle, a sewing machine equipped with a threading device that prevents the top thread from dropping onto, landing on, or coiling around an operation part of an operation lever (operation part) of the threading device at the end part of the threading operation before the top thread is passed through the needle.

BACKGROUND ART

Various threading devices have been proposed for domestic sewing machines to allow a thread to pass through the needle hole of the sewing machine needle. Many of them are manually operated, in which an operation part of an operation lever of the threading device is pressed down from its top position to bring a threader close to the needle hole of the sewing machine needle to get the top thread to pass through the needle hole. There are many of this type that are used commonly.

Normally, as a preceding step prior to needle threading operation of a domestic sewing machine, the top thread is threaded. In this threading of the top thread, a top thread is pulled out from a bobbin mounted at a predetermined position of the sewing machine body, hooked at predetermined positions, and hooked to a thread holder that is provided for passing the thread through the needle hole of the sewing machine needle, after which surplus top thread is cut off with a cutter attached to a face plate of the sewing machine body.

The main structure and operation steps of threading devices of the manually operated type, in which an operation part of an operation lever of the threading device is pressed down to bring a thread holder together with a threader close to the needle hole of the sewing machine needle to get the top thread to pass through the needle hole, are as described above. Typical threading devices of this type are disclosed in PTL 1 and PTL 2. Many of manually operated threading devices have substantially the same main structure and operation steps as those of PTL 1 and PTL 2.

CITATION LIST

Patent Literature

[PTL 1] Japanese Patent Application Publication No. H08-173676

[PTL 2] Japanese Patent Application Publication No. 2000-271372

SUMMARY OF INVENTION

Technical Problem

The threading devices of the manually operated type of domestic sewing machines let the top thread n pass through the needle hole of the sewing machine needle c when an operation part of an operation lever a is pressed down with a fingertip, as illustrated in FIG. 9(A). When a surplus of the top thread n is cut off with a cutter b attached to a face plate of the sewing machine body, there is a possibility that the end part of the top thread n that has been cut drops down onto the operation part and stays on the upper surface of the operation part a. It is also possible that the end part of the top thread n coils around the operation part a.

If the person about to perform the threading operation presses down the operation part a of the operation lever with the top thread n thereon, the top thread n will be firmly held between the fingertip and the operation part as illustrated in FIG. 9. The tension created on the top thread n may hinder the rotary motion of the thread holder on a horizontal plane when the thread holder comes to the same height as the position of the needle hole of the sewing machine needle, because of which the top thread may not be able to pass through the needle hole. In some cases, it is possible that the operation lever cannot be lowered at all. It is fully conceivable that in the worst scenario the device may be broken.

A top thread end part that has dropped onto and stayed on the operation part a of the operation lever of the threading device after the top thread n has been cut by the cutter b in the last stage of the threading operation can lead to various troubles in this way in the operation of a domestic sewing machine. Accordingly, an object of the present invention is to provide a sewing machine equipped with a threading device which, with a very simple configuration, can prevent the top thread from dropping onto, landing on, or coiling around the operation part a of the operation lever of the threading device of a domestic sewing machine at the end part of the threading operation before the top thread is passed through the needle hole of the sewing machine needle.

Solution to Problem

To solve the problem described above, the inventors went through intensive research, and devised an invention set forth in claim 1, which is a sewing machine equipped with a threading device, including: a needle bar to which a sewing machine needle is attached; a threading shaft supported such as to be movable up and down and rotatable in a circumferential direction; a thread holder provided at a lower end of the threading shaft; a threader provided at a lower end of the threading shaft and having a hook made to stick out through a needle hole to pass a thread through the needle hole; an operation lever having an operation part for operation and causing the threading shaft to move up and down and to rotate in a circumferential direction; a cutter for a top thread; and a top thread guide member provided between the thread holder and the cutter and formed with an inclined part that guides the top thread from the thread holder to the cutter, the inclined part of the top thread guide member being configured to guide the top thread that has been cut by the cutter to outside of an operation area of the operation lever, and which solves the problem described above.

The problem described above is solved by the invention set forth in claim 2, which is the sewing machine equipped with a threading device according to claim 1, wherein the inclined part of the top thread guide member is formed as an inclined surface that guides a top thread that is being threaded from the thread holder over to the cutter. The problem described above is solved by the invention set forth in claim 3, which is the sewing machine equipped with a threading device according to claim 2, wherein the inclined surface has a side edge on a face plate side of a sewing machine body including a side edge portion located higher than the operation part, the side edge portion being inclined from a front side to a back side in Y-direction of the sewing machine body toward the face plate side in X-direction of the sewing machine body as viewed from above. The problem described above is solved by the invention set forth in claim 4, which is the sewing machine equipped with a threading device according to either one of claim 2 or 3, further including a plate-shaped auxiliary guide piece formed along X-direction at an end part on a front side of Y-direction of the inclined surface.

The problem described above is solved by the invention set forth in claim 5, which is the sewing machine equipped with a threading device according to claim 1, wherein the top thread guide member includes a vertical plate-shaped part having a circular arc curved surface and formed integrally to the operation lever with a longitudinal direction thereof extending along Y-direction. The problem described above is solved by the invention set forth in claim 6, which is the sewing machine equipped with a threading device according to claim 5, wherein the auxiliary guide part is formed with an auxiliary slope from a column side to a face plate side along X-direction inclined to recede toward a back side in Y-direction.

Advantageous Effects of Invention

According to the invention set forth in claim 1, a top thread guide member formed with an inclined part that guides the top thread from a thread holder toward a cutter is provided between the thread holder and the cutter, and the inclined part is configured to guide the top thread to outside an operation area of the operation lever. Accordingly, in the last stage of threading operation of the domestic sewing machine, an end part of the top thread immediately after being cut by the cutter attached to the face plate of the sewing machine body is guided to the outside of the operation area of the operation lever.

Therefore, a person about to perform a sewing operation with a domestic sewing machine, when operating the operation lever during the threading operation of the top thread with the threading device to pass the top thread through the needle hole of the sewing machine needle, is prevented from accidentally holding down the top thread end part firmly on the operation part, which will hinder the threading operation. The inclined part of the top thread guide member guides the top thread from the thread holder toward the cutter, which enables very smooth transition from machine threading operation to needle threading operation.

According to the invention set forth in claim 2, the inclined part of the top thread guide member is formed as an inclined surface that guides the top thread that is being threaded from the thread holder over to the cutter. This ensures that excess stress is hardly applied to the top thread so that the top thread can be maintained in a favorable state. According to the invention set forth in claim 3, the inclined surface has a side edge on a face plate side of a sewing machine body including a side edge portion located higher than the operation part, the side edge portion being inclined from a front side to a back side in Y-direction of the sewing machine body toward the face plate side in X-direction of the sewing machine body as viewed from above. In the last stage of threading, the portion of the top thread to be cut can be smoothly guided to the cutter, and the end part of the top thread after being cut off can be quickly removed to the outside of the operation part of the operation lever.

According to the invention set forth in claim 4, the sewing machine equipped with a threading device further includes a plate-shaped auxiliary guide piece formed along X-direction at an end part on a front side of Y-direction of the inclined surface. By passing the top thread through the auxiliary guide piece inward of the Y-direction during the threading operation, the top thread passing on the inclined surface is prevented from coming off of the inclined surface until cut by the cutter. Thus the threading operation is made even smoother until the last stage where the top thread is cut off. The side edge portion has a circular arc shape in an orthogonal cross section so that the top thread is unlikely to be damaged and can be maintained in a favorable condition.

According to the invention set forth in claim 5, the top thread guide member includes a vertical plate-shaped part having a circular arc curved surface and formed integrally to the operation lever with a longitudinal direction thereof extending along Y-direction. When operating the operation lever during the threading operation of the top thread with the threading device to pass the top thread through the needle hole of the sewing machine needle, the operator is prevented from accidentally holding down a top thread end part firmly on the operation part, which will hinder the threading operation. Moreover, the inclined part of the top thread guide member guides the top thread from the thread holder toward the cutter, which enables very smooth transition from machine threading operation to needle threading operation. The vertical plate-shaped part has a circular arc shape in a cross section orthogonal to an outer peripheral edge so that the top thread is unlikely to be damaged during the machine threading operation and needle threading operation and can be maintained in a favorable condition. According to the invention set forth in claim 6, the auxiliary guide part is formed with an auxiliary slope from a column side to a face plate side along X-direction inclined to recede toward a back side in Y-direction. This enables the top thread to be moved from the auxiliary guide part to the vertical plate-shaped part very smoothly in the threading operation.

BRIEF DESCRIPTION OF DRAWINGS

FIG. 1(A) is a schematic front view of a sewing machine equipped with a threading device of a first embodiment of the present invention, FIG. 1(B) is an enlarged view of part (a) of FIG. 1(A) with some parts left out, and FIG. 1(C) is a cross section X1-X1 viewed in the direction of arrows of FIG. 1(B) with some parts left out.

FIG. 2(A) is a perspective view of a top thread guide member and a partially cut-off operation lever of the first embodiment, FIG. 2(B) is a plan view of the top thread guide member of the first embodiment, FIG. 2(C) is a cross section Y1-Y1 viewed in the direction of arrows of FIG. 2(B), and FIG. 2(D) shows FIG. 2(B) as viewed in the direction of arrows Y2-Y2.

FIG. 4(A) is an enlarged view illustrating major parts of a threading device and part of a face plate of the sewing machine body of a second embodiment according to the present invention, FIG. 4(B) shows FIG. 4(A) as viewed in the direction of arrows X2-X2, FIG. 4(C) is a diagram of a state in which an inclined part and an auxiliary guide part are separated away from each other as viewed in the direction of arrows Y5-Y5 of FIG. 4(A), and FIG. 4(D) is a perspective view of the inclined part and the auxiliary guide part spaced away from each other.

FIG. 7(A) is a front view of a threading assembly in the present invention, FIG. 7(B) is a cross section X6-X6 viewed in the direction of arrows of FIG. 7(A) in a state before the threading, with some parts being left out, and FIG. 7(C) is a cross section X6-X6 viewed in the direction of arrows of FIG. 7(A) in a state when the threading is complete, with some parts being left out.

DESCRIPTION OF EMBODIMENTS

Figure 8:
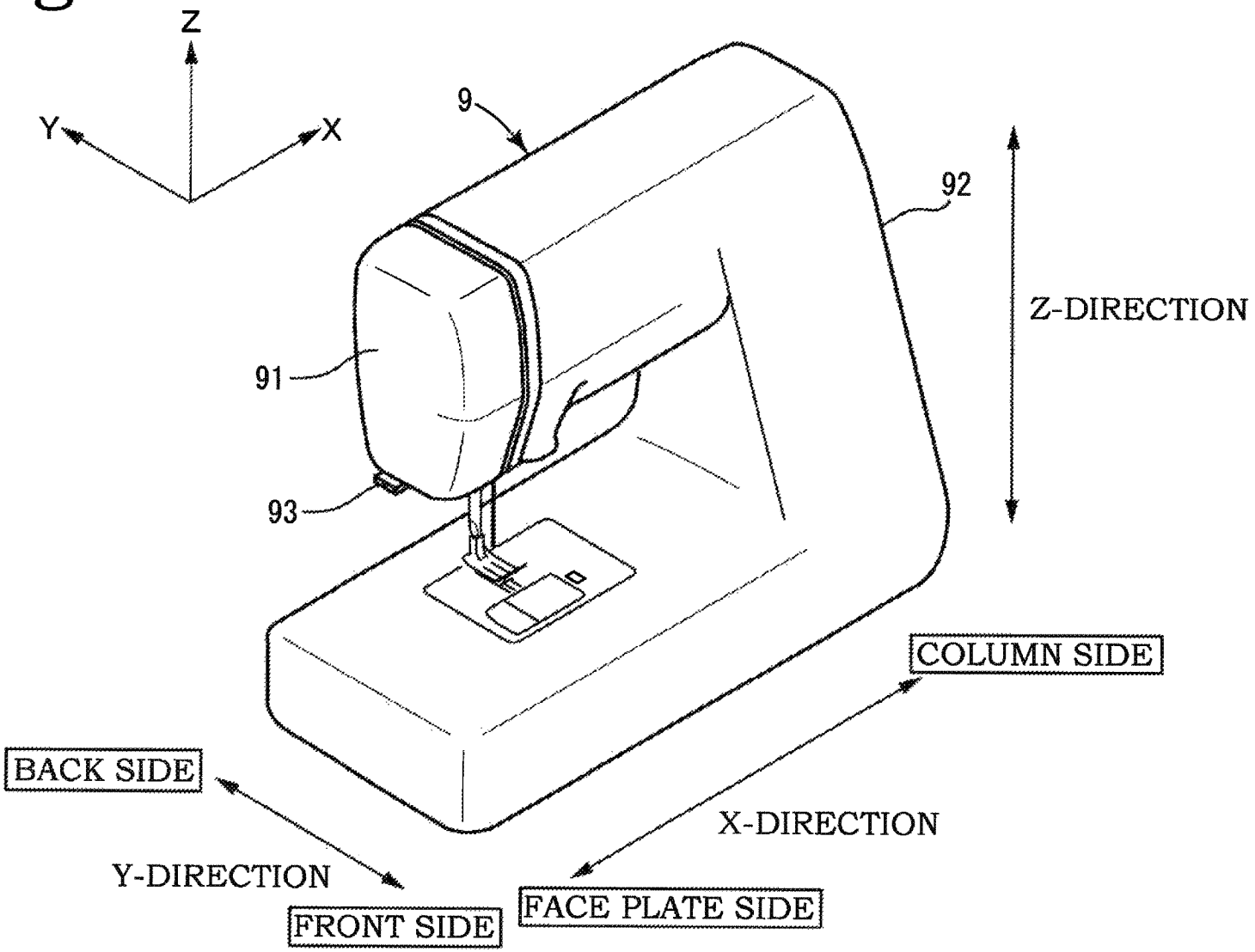
FIG. 8 is a perspective view of a sewing machine indicating the X-direction, Y-direction, and Z-direction.
Figure 9B:
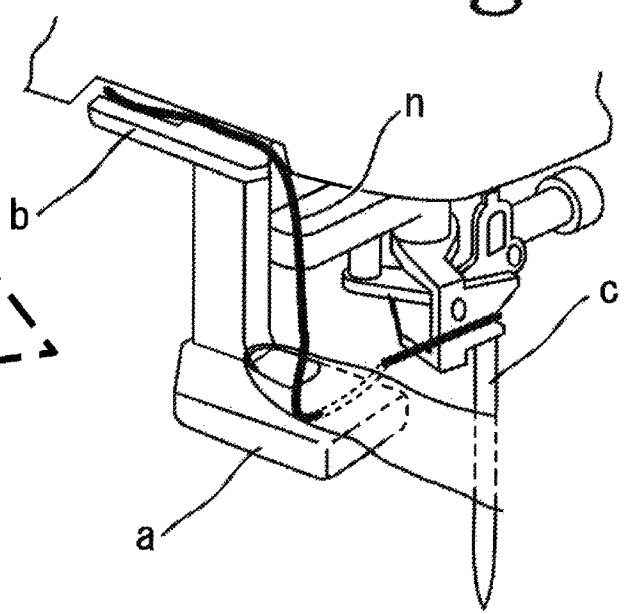
FIG. 9(A) and FIG. 9(B) are perspective views of major parts illustrating an existing drawback.
Figure 9A:
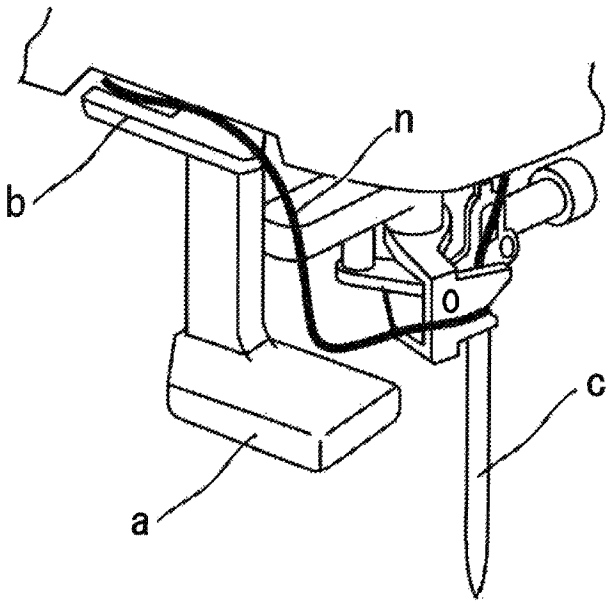

Hereinafter, embodiments of the present invention will be described with reference to the drawings. In the following description, X-direction, Y-direction, and Z-direction are defined (see FIG. 8). The X-direction is the direction connecting a face plate 91 and a column 92 of the sewing machine body 9. The Y-direction is the direction connecting the front side and the backside of the sewing machine body 9. The Z-direction is the direction of height of the sewing machine body 9.

Hereinafter, the major components of the present invention shall be described with reference to the X-direction, Y-direction, and Z-direction, supposing that they are attached to the sewing machine body 9. Specifically, specific sides of the X-direction and the Y-direction shall be referred to as the face plate side or the column side of the X-direction, and the front side or the back side of the Y-direction, respectively.

The threading device in the present invention includes, as main components, a top thread guide member A and a threading assembly 5 associated with the threading as illustrated in FIG. 1(A). First, the threading assembly 5 to which the top thread guide member A is attached will be described. The threading assembly 5 includes a support frame body 51, a needle bar 52, a threading shaft 53, a thread holder 71, and a threader 72. The support frame body 51, in which the needle bar 52, threading shaft 53, and a guide shaft 54 are attached, is mounted inside the sewing machine body 9.

A plurality of shaft support parts are formed in the support frame body 51 for supporting the needle bar 52, threading shaft 53, and guide shaft 54. The needle bar 52, threading shaft 53, and guide shaft 54 are supported such as to be slidable up and down relative to the support frame body 51 (see FIG. 7(A)). The support frame body 51 is mounted inside a face plate 91 of the sewing machine body 9 and supports the needle bar 52 such as to be movable up and down and rotatable in a direction orthogonal to the fabric feed direction (left and right). One end of a spring is attached to the upper side of the support frame body 51, while the other end of the spring is attached to an operation lever 4. The threading shaft 53 and guide shaft 54 connected to this operation lever 4 are always spring-biased upwards. The needle bar 52 is a bar-like member with a needle 6 attached to a tip portion.

The threading shaft 53 lowers the thread holder 71 and threader 72 down to a position where the top thread n can be passed through the needle hole 61 of the needle 6 (threading position). The threading shaft 53 serves the function of causing the thread holder 71 and threader 72 to rotate alternately in opposite directions. The guide shaft 54 moves up and down with the threading shaft 53 within the same range relative to the support frame body 51 (see FIG. 7(A)). The threader 72 is provided with a hook 72*a* for passing the top thread n through the needle hole 61. During the threading operation, the hook 72*a* passes through the needle hole 61.

The operation lever 4 includes an operation part 41 and a lever shaft part 42. The operation part 41 is formed at the lower end of the lever shaft part 42. A connecting shaft support part 42*a* that is connected to the threading shaft 53 and guide shaft 54 is formed at the upper end of the lever shaft part 42. The operation part 41 is formed as a plate piece extending in a horizontal plane to allow an operator to press down the operation part 41 to cause the guide shaft 54 and threading shaft 53 to move down together with the operation lever 4.

The top thread guide member A, after guiding the top thread n toward a position where there is a cutter 93 during the threading operation of the top thread n, and after the cutter 93 has cut off a surplus of the thread, serves the function of preventing the top thread n from dropping onto or landing on the operation part 41 of the operation lever 4. There are several embodiments of the top thread guide member A. First, the first embodiment will be described. In all embodiments, the top thread guide member A has an inclined part 1 (see FIG. 1 to FIG. 3). The cutter 93, specifically, is a planer blade, which is generally built in the sewing machine body 9 on the face plate 91 in an end part on the face plate 91 side of the X-direction (see FIG. 8).

The top thread guide member A has the inclined part 1, an attachment part 2, and an auxiliary guide piece 12 (see FIG. 2). The inclined part 1 has an inclined surface 11, this inclined surface 11 being a surface inclined upward from the column 92 side to the face plate 91 side along the X-direction of the sewing machine body 9 in a state in which the inclined part is attached correctly to the sewing machine body 9 (see FIG. 1(A), FIG. 2(A), and FIG. 2(C)). The angle of the slope is 20 degrees relative to horizontal, which may be more or less than about 20 degrees.

The inclined surface 11 is substantially quadrate when viewed from above, and has substantially L-shaped side edges. The side extending along the X-direction of the inclined surface 11 on the front side in the Y-direction shall be referred to as a first side edge portion 11*a*. The side extending along the Y-direction of the inclined surface 11 on the face plate 91 side in the X-direction shall be referred to as a second side edge portion 11*b*. The first side edge portion 11*a* is gradually inclined to recede toward the back side of the Y-direction, from the column 92 side to the face plate 91 side along the X-direction (see FIG. 2(B)).

The second side edge portion 11*b* is gradually inclined to protrude toward the face plate 91 side from the column 92 side of the X-direction from the front side to the back side along the Y-direction (see FIG. 1(A), FIG. 2(B), FIG. 3(A), and FIG. 3(C)). The first side edge portion 11*a* and the second side edge portion 11*b* each have a circular arc shape in cross sections orthogonal to each other (see FIG. 2(A) and FIG. 2(C), etc.).

At an end part on the front side in the Y-direction of the inclined surface 11, i.e., on the first side edge portion 11*a*, the plate-shaped auxiliary guide piece 12 is formed along the X-direction of the sewing machine body 9 to be perpendicular to the inclined surface 11. This auxiliary guide piece 12 serves the function of guiding the top thread n drawn out from the thread holder 71 onto the inclined surface 11 and preventing the top thread n, which is once put on the inclined surface 11, from readily slipping down the inclined surface 11. The auxiliary guide piece 12 may have an engraved arrow that indicates the threading direction of the top thread n.

Figure 3A:
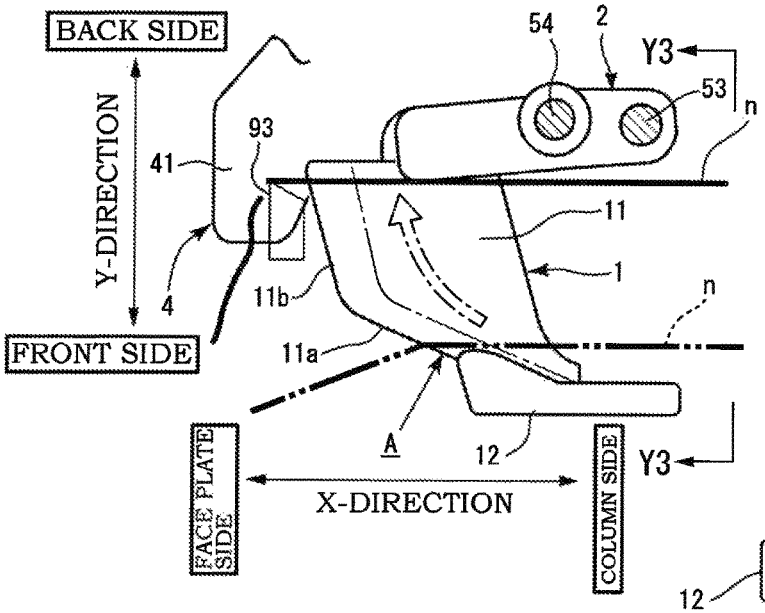
FIG. 3(A) is a plan view of the top thread guide member of the first embodiment cutting the top thread.
Figure 3B:
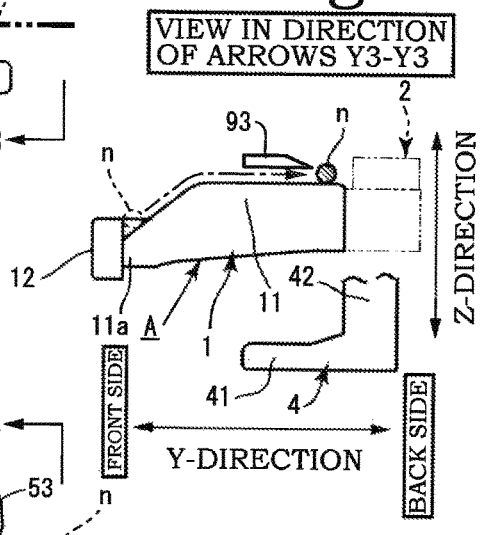
FIG. 3(B) shows FIG. 3(A) as viewed in the direction of arrows Y3-Y3.

The inclined surface 11 can cause the top thread n to smoothly move to the position where there is the cutter 93 attached to the face plate 91 of the sewing machine body 9, as the top thread n drawn out from the thread holder 71 is moved from an end part on the front side of the Y-direction along the first side edge portion 11*a* and the second side edge portion 11*b* (see FIG. 3(A) and FIG. 3(B)).

The attachment part 2 is formed at one end part on the back side in the Y-direction of the inclined surface 11 and attached to the threading shaft 53 and guide shaft 54 of the threading assembly 5. Operation of the operation lever 4 attached to the guide shaft 54 moves the top thread guide member A up and down together with the threading shaft 53 and guide shaft 54. The attachment part 2 also doubles as a linking guide member to cause the thread holder 71 and the threader 72 of the threading assembly 5 to rotate. The top thread guide member A is primarily made of synthetic resin, but may be made of metal.

Next, the effect of the top thread guide member A of the first embodiment will be explained. In the last stage of threading of the top thread n, first, the top thread n drawn out from the thread holder 71 of the sewing machine body 9 comes to rest on the inclined surface 11 from the back side of the auxiliary guide piece 12 of the top thread guide member A. The top thread n is then moved to the position of the cutter 93, where a surplus of the top thread n is cut off, so that the top thread n drawn out from the thread holder 71 has a correct length (see FIG. 3(A) and FIG. 3(B)).

Figure 3C:
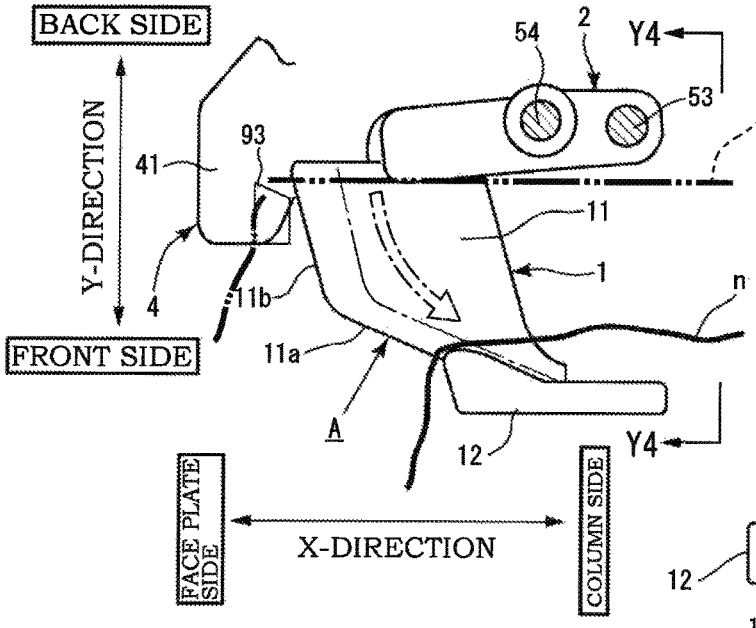
FIG. 3(C) is a plan view of the top thread guide member of the first embodiment immediately after having cut the top thread.
Figure 3D:
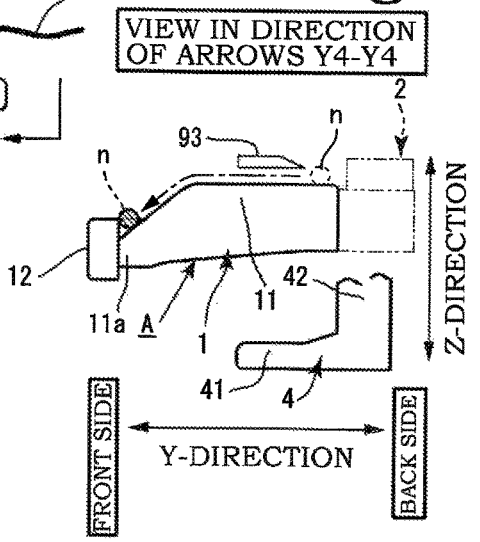
FIG. 3(D) shows FIG. 3(C) as viewed in the direction of arrows Y4-Y4.

The top thread n with a correct length from the thread holder 71 stays on the inclined surface 11 (see FIG. 3(A)), so that the top thread n does not drop onto or land on the operation part 41 of the operation lever 4, and thus the top thread n is kept away from the operation part 41 (see FIG. 3(C) and FIG. 3(D)). Thus the operator is prevented from accidentally pressing down the operation part 41 while holding the top thread n between the fingertip and the operation part 41.

To ensure that the top thread n cut by the cutter 93 does not drop onto or land on the upper surface of the operation part 41 as described above, preferably, the end position on the front side in the Y-direction of the inclined surface 11 of the inclined part 1 of the top thread guide member A should be located further on the front side in the Y-direction than the end position on the front side in the Y-direction of the operation part 41 of the operation lever 4 (see FIG. 3).

Figures 5A, 5B, 5C:
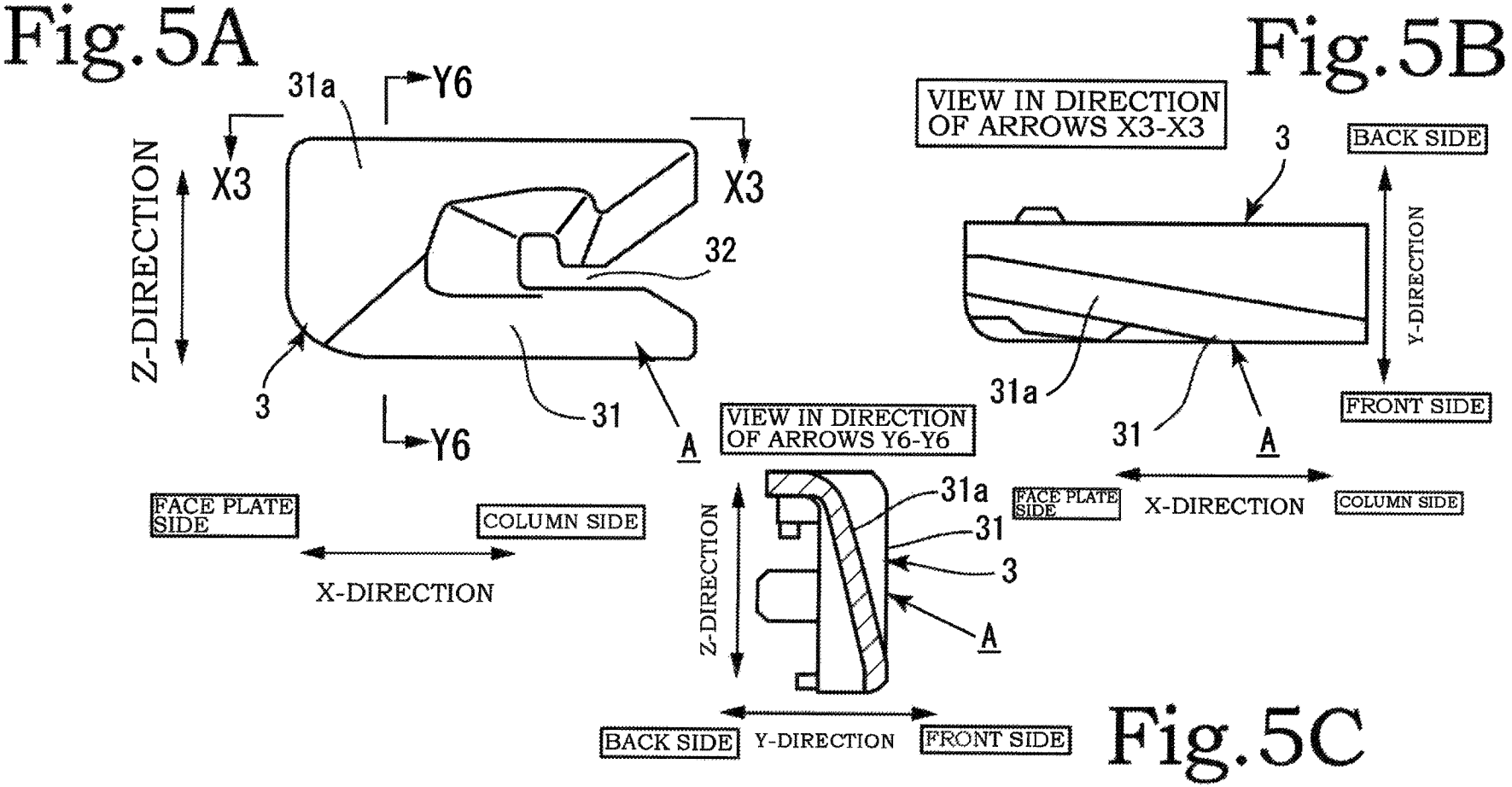
FIG. 5(A) is a front view of the auxiliary guide part of the second embodiment.
FIG. 5(B) shows FIG. 5(A) as viewed in the direction of arrows X3-X3.
FIG. 5(C) is a cross section Y6-Y6 viewed in the direction of arrows of FIG. 5(A).
Figures 6A, 6B, 6C, 6D:
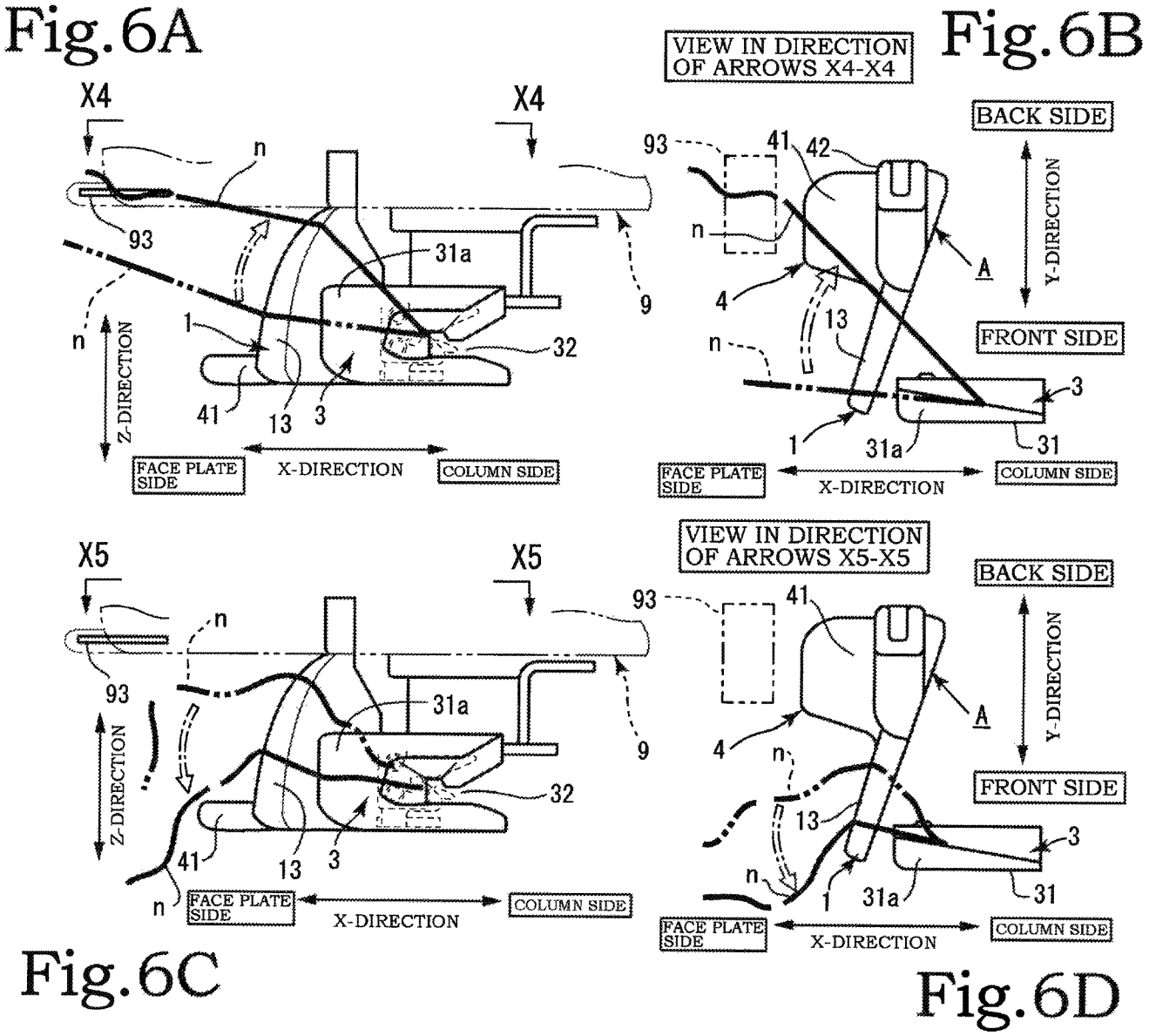
FIG. 6(A) is a front view of the top thread guide member of the second embodiment cutting the top thread.
FIG. 6(B) shows FIG. 6(A) as viewed in the direction of arrows X4-X4.
FIG. 6(C) is a front view of the top thread guide member of the second embodiment immediately after having cut the top thread.
FIG. 6(D) shows FIG. 6(C) as viewed in the direction of arrows X5-X5.

Next, a second embodiment of the top thread guide member A will be described (see FIG. 4 and FIG. 5). In the second embodiment, the guide member includes an inclined part 1 and an auxiliary guide part 3 (see FIG. 4). The inclined part 1 is a vertical plate-shaped part 13. The vertical plate-shaped part 13 is planer and substantially in a fan shape. The vertical plate-shaped part 13, more specifically, is a plate-shaped part in a quarter circle shape (see FIG. 4(C) and FIG. 4(D)). The vertical plate-shaped part 13 is disposed such that its vertical surface extends along the Y-direction of the sewing machine body 9. More specifically, the vertical plate-shaped part 13 is slightly inclined from the line along the Y-direction such that its front side is closer to the face plate 91 side of the X-direction than the back side (see FIG. 4(A), FIG. 4(B), FIG. 6(A), and FIG. 6(B)).

Further, the vertical plate-shaped part 13 is configured to gradually increase in height from the end part on the front side toward the end part on the back side along the Y-direction of the sewing machine body 9 (see FIG. 4(C) and FIG. 4(D)). The topmost point of the vertical plate-shaped part 13 is in close vicinity to the cutter 93 attached to the face plate 91 to allow cutting of the top thread n. The vertical plate-shaped part 13 is formed to have a circular arc shape in a cross section orthogonal to an outer peripheral edge thereof (see FIG. 4(C) and FIG. 4(D)). Preferably, the end position on the front side in the Y-direction of the vertical plate-shaped part 13 should be located further on the front side in the Y-direction than the end position on the front side in the Y-direction of the operation part 41 of the operation lever 4 (see FIG. 4(B)).

The auxiliary guide part 3 is a cover-like member that covers the thread holder 71 of the threading assembly 5 (see FIG. 4(A) and FIG. 5). The auxiliary guide part 3 has a similar shape as the thread holder 71, and includes a guide body part 31 and a guide passage part 32 (see FIG. 4(A), FIG. 4(D), FIG. 5 etc.). The guide body part 31 is attached as a cover to the thread holder 71. The guide body part 31 rotates on the horizontal plane together with the thread holder 71 during the threading operation. In a normal non-operating state, the front side of the guide body part 31 extends along the X-direction of the sewing machine body 9, and during the threading operation the front side of the guide body part 31 extends along the Y-direction of the sewing machine body 9 (see FIG. 6(B) and FIG. 6(C)).

The guide body part 31 has on its front side an inclined surface inclined from the column 92 side of the X-direction to the face plate 91 side of the sewing machine body 9 so that the face plate 91 side is receded toward the back side of the Y-direction (see FIG. 5). Moreover, the guide body part 31 has an inclined surface inclined from the lower end to the upper end in the Z-direction of the sewing machine body 9 so that the upper end is receded toward the back side of the Y-direction. These two inclined surfaces formed on the guide body part 31 merge and together form an auxiliary guide slope 31*a* (see FIG. 5).

The auxiliary guide part 3 is in close proximity to a part of the vertical plate-shaped part 13 of the inclined part 1 closer to the front side of the Y-direction (see FIG. 4(A) and FIG. 4(B)). The vertical plate-shaped part 13 and the auxiliary guide slope 31*a* of the guide body part 31 are formed to have a substantially equal slope so that the top thread n can smoothly move from the auxiliary guide part 3 to the vertical plate-shaped part 13 of the inclined part 1. The guide passage part 32 is open on the column 92 side of the X-direction, which is a section that introduces the top thread n (see FIG. 4(A), FIG. 4(B), and FIG. 5(A)).

Next, the effect of the top thread guide member A of the second embodiment will be explained. In the last stage of threading of the top thread n, first, the top thread n drawn out from the guide passage part 32 of the auxiliary guide part 3 covering the thread holder 71 of the sewing machine body 9 moves toward the front side in the Y-direction of the vertical plate-shaped part 13 of the top thread guide member A, and then the top thread n moves from near the lower end in the Z-direction to its topmost position along the outer circumference of the vertical plate-shaped part 13. The top thread n that has reached the topmost position of the vertical plate-shaped part 13 is cut by the cutter 93 (see FIG. 6(A) and FIG. 6(B)).

The top thread n that has been cut drops down in the Z-direction along the outer circumference of the vertical plate-shaped part 13 and further down below the end part on the front side of the Y-direction. The end part on the front side in the Y-direction of the vertical plate-shaped part 13 lets the top thread drop such as to avoid the operation part 41 so that the top thread n does not land on the operation part 41 (see FIG. 6(C) and FIG. 6(D)). Thus the operator is prevented from accidentally pressing down the operation part 41 while holding the top thread n between the fingertip and the operation part 41.

REFERENCE SIGNS LIST

1 Inclined part
11 Inclined surface
11*a* First side edge portion
11*b* Second side edge portion
12 Auxiliary guide piece
13 Vertical plate-shaped part
3 Auxiliary guide part
31*a* Auxiliary guide slope
4 Operation lever
41 Operation part
52 Needle bar
53 Threading shaft
71 Thread holder
72 Threader
n Top thread
93 Cutter

The invention claimed is:

1. A sewing machine equipped with a threading device, comprising: a needle bar to which a sewing machine needle is attached; a threading shaft supported such as to be movable up and down and rotatable in a circumferential direction; a thread holder provided at a lower end of the threading shaft; a threader provided at the lower end of the threading shaft and having a hook made to stick out through a needle hole to pass a thread through the needle hole; an operation lever having an operation part for operation and causing the threading shaft to move up and down and to rotate in the circumferential direction; a cutter for a top thread; and a top thread guide member provided between the thread holder and the cutter and formed with an inclined part that guides the top thread from the thread holder to the cutter, the inclined part of the top thread guide member being configured to guide the top thread that has been cut by the cutter to outside of an operation area of the operation lever.

2. The sewing machine equipped with a threading device according to claim 1, wherein the inclined part of the top thread guide member is formed as an inclined surface that guides the top thread that is being threaded from the thread holder over to the cutter.

3. The sewing machine equipped with a threading device according to claim 2, wherein the inclined surface has a side edge on a face plate side of a sewing machine body including a side edge portion located higher than the operation part, the side edge portion being inclined from a front side to a back side in Y-direction of the sewing machine body toward the face plate side in X-direction of the sewing machine body as viewed from above.

4. The sewing machine equipped with a threading device according to claim 3, further comprising a plate-shaped auxiliary guide piece formed along X-direction at an end part on a front side in Y-direction of the inclined surface.

5. The sewing machine equipped with a threading device according to claim 2, further comprising a plate-shaped auxiliary guide piece formed along X-direction at an end part on a front side in Y-direction of the inclined surface.

6. The sewing machine equipped with a threading device according to claim 1, wherein the top thread guide member includes a vertical plate-shaped part having a circular arc curved surface and formed integrally to the operation lever with a longitudinal direction thereof extending along Y-direction.

7. The sewing machine equipped with a threading device according to claim 6, wherein an auxiliary guide part is formed with an auxiliary slope from a column side to a face plate side along X-direction inclined to recede toward a back side in Y-direction.

* * * * *